US008192335B2

(12) United States Patent
Pullaro

(10) Patent No.: US 8,192,335 B2
(45) Date of Patent: Jun. 5, 2012

(54) STRENGTH AND CONDITIONING DEVICE AND METHOD OF CONDITIONING

(76) Inventor: Terry J. Pullaro, St. Louis, MO (US)

( * ) Notice: Subject to any disclaimer, the term of this patent is extended or adjusted under 35 U.S.C. 154(b) by 0 days.

(21) Appl. No.: 11/273,803

(22) Filed: Nov. 15, 2005

(65) Prior Publication Data

US 2007/0111867 A1 May 17, 2007

(51) Int. Cl.
*A63B 15/00* (2006.01)
*A63B 21/00* (2006.01)
*A63B 21/06* (2006.01)

(52) U.S. Cl. ..... 482/109; 482/50; 482/93; 482/129

(58) Field of Classification Search ..... 482/83, 482/109, 121, 129, 130; 473/229, 256, 437, 473/456, 463; D21/773; 434/252
See application file for complete search history.

(56) References Cited

U.S. PATENT DOCUMENTS

| | | | | |
|---|---|---|---|---|
| 356,299 | A | 1/1887 | Alexander | |
| 2,756,055 | A * | 7/1956 | Bittner | 473/338 |
| 2,788,214 | A * | 4/1957 | Tilden | 473/213 |
| 2,884,816 | A | 5/1959 | Lay | |
| 3,462,156 | A * | 8/1969 | Gentry | 473/229 |
| 3,543,715 | A | 12/1970 | Hill | |
| 3,618,942 | A * | 11/1971 | Bates et al. | 482/129 |
| 3,930,525 | A | 1/1976 | Stonebuner | |
| 3,955,816 | A | 5/1976 | Bratt | |
| 3,966,203 | A * | 6/1976 | Bickford | 482/103 |
| 4,192,500 | A | 3/1980 | Crow et al. | |
| 4,272,077 | A | 6/1981 | Spivey | |
| 4,328,964 | A * | 5/1982 | Walls | 482/129 |
| 4,378,113 | A | 3/1983 | Piccini | |
| 4,444,396 | A | 4/1984 | Wendt | |
| 4,449,708 | A * | 5/1984 | Humphrey | 473/229 |
| 4,600,190 | A * | 7/1986 | Berokoff | 482/129 |
| 4,602,788 | A | 7/1986 | Wendt | |
| 4,819,935 | A | 4/1989 | Dirksing et al. | |
| 4,869,511 | A | 9/1989 | Spoonster, Sr. | |
| 4,898,384 | A | 2/1990 | Beach | |
| 4,982,963 | A | 1/1991 | Fazio | |
| 5,052,869 | A * | 10/1991 | Hansen, II | 410/111 |

(Continued)

FOREIGN PATENT DOCUMENTS

GB 2373454 A 9/2002

OTHER PUBLICATIONS

*Merck & Co., Inc.* v. *Biocraft Laboratories, Inc.* 10 USPQ2d 1843 (CA FC 1989).

*Primary Examiner* — Loan Thanh
*Assistant Examiner* — Sandhara Ganesan
(74) *Attorney, Agent, or Firm* — Polster Lieder Woodruff & Lucchesi, L.C.

(57) ABSTRACT

A strength and conditioning device and method of conditioning. A conditioning device for a sport using a hand held implement having a grip portion comprises a handle shaped like the grip portion, the handle having a first end and a second end. A weight is positioned on the second end such that a center of mass for the conditioning device is less than about 13 inches from the first end of the handle. A bias assembly is removably attached to the weight such that the bias assembly resists movement of the weight during at least some motion of the handle.

14 Claims, 4 Drawing Sheets

U.S. PATENT DOCUMENTS

| | | | | | |
|---|---|---|---|---|---|
| 5,083,790 | A | | 1/1992 | Wheatley | |
| 5,121,925 | A | | 6/1992 | Blundo | |
| 5,209,482 | A | * | 5/1993 | Hopfer | 473/216 |
| 5,215,307 | A | | 6/1993 | Huffman | |
| 5,248,176 | A | * | 9/1993 | Fredriksson | 294/1.1 |
| 5,312,308 | A | | 5/1994 | Hamilton et al. | |
| 5,330,190 | A | | 7/1994 | Oakley, Jr. | |
| 5,330,193 | A | | 7/1994 | Ijiri | |
| 5,524,893 | A | * | 6/1996 | McGinnis et al. | 473/229 |
| 5,593,155 | A | | 1/1997 | Fauble et al. | |
| 5,681,225 | A | * | 10/1997 | Cary | 473/229 |
| 5,697,871 | A | * | 12/1997 | Landfair | 482/82 |
| 5,735,544 | A | | 4/1998 | Buckner | |
| 5,755,633 | A | | 5/1998 | Marquez | |
| 5,769,734 | A | * | 6/1998 | Qualey, Sr. | 473/233 |
| 5,807,183 | A | | 9/1998 | Benson | |
| 5,865,686 | A | | 2/1999 | MacGregor | |
| 5,957,819 | A | | 9/1999 | Cortesi | |
| D428,461 | S | | 7/2000 | Koszalinski | |
| 6,083,116 | A | | 7/2000 | Loredo | |
| 6,138,879 | A | | 10/2000 | Breuner | |
| 6,138,975 | A | * | 10/2000 | McDaid | 248/499 |
| 6,228,002 | B1 | | 5/2001 | Dantolan | |
| 6,379,261 | B1 | | 4/2002 | Hart | |
| 6,918,721 | B2 | * | 7/2005 | Venton-Walters et al. | 410/102 |
| 6,949,035 | B1 | * | 9/2005 | Halsworth | 473/453 |
| 7,134,819 | B2 | * | 11/2006 | Bullock et al. | 410/102 |
| 2002/0165070 | A1 | * | 11/2002 | Pullaro | 482/109 |
| 2003/0182764 | A1 | * | 10/2003 | Jeffries | 16/445 |
| 2004/0009826 | A1 | * | 1/2004 | Aisenberg | 473/256 |
| 2005/0014571 | A1 | * | 1/2005 | Varner | 473/257 |
| 2005/0137064 | A1 | * | 6/2005 | Nothnagle | 482/108 |

* cited by examiner

STRENGTH AND CONDITIONING DEVICE AND METHOD OF CONDITIONING

CROSS-REFERENCE TO RELATED APPLICATIONS

Not Applicable.

STATEMENT REGARDING FEDERALLY SPONSORED RESEARCH

Not Applicable.

BACKGROUND OF THE DISCLOSURE

This disclosure relates to a conditioning device, and in particular, to a conditioning device for training and conditioning for sports which use an implement, such as a club, wherein the conditioning device provides weighted and resistant forces against the user.

There are a wide variety of sports training and conditioning devices for sports that employ some sort of implement. A common example is the batting donut, which is slipped over the narrow end of the bat and slid down the shaft of the bat to add extra weight to the end of the bat while taking practice swings. Similar devices are available for golf clubs and for other sports implements. One draw back of these devices is that the extra weight is usually concentrated to condition upper torso strength. This unnecessarily strains the user's wrist, and particularly the user's shoulders, and does not concentrate the training and conditioning on the user's forearms which, in most sports, are critical to the proper use of the implement. Additionally, these devices do not provide a resistive force during use of the device.

SUMMARY OF THE DISCLOSURE

This disclosure relates to a conditioning device, and in particular, to a conditioning device for training and conditioning for sports which use an implement, such as a club, wherein the conditioning device provides weighted and resistant forces applied to the user.

In an embodiment, the conditioning device, for a sport using a hand held implement having a grip portion, comprises a handle shaped like the grip portion. The handle has a first end and a second end, wherein a weight is positioned on the second end of the handle. A bias assembly removably attaches to the weight such that the bias assembly resists movement of the weight during motion of the handle.

In an embodiment, the present disclosure relates to a method of exercising for a sport that uses a hand held implement having a grip portion. The exercising method comprises grasping a conditioning device having a handle shaped like the grip portion. The user removably attaches a bias assembly to the handle. The user also removably attaches the bias assembly to a secondary object. The user then swings the conditioning device wherein the bias assembly resists motion of the conditioning device when attached to the secondary object.

BRIEF DESCRIPTION OF THE SEVERAL VIEWS OF THE DRAWINGS

The objects of the disclosure are achieved as set forth in the illustrative embodiments shown in the drawings, which form part of the specification.

DESCRIPTION OF THE PREFERRED EMBODIMENT

The following detailed description illustrates the disclosure by way of example and not by way of limitation. The description clearly enables one skilled in the art to make and use the disclosure, describes several embodiments, adaptations, variations, alternatives, and uses of the disclosure, including what is presently believed to be the best mode of carrying out the disclosure.

Figure 1:
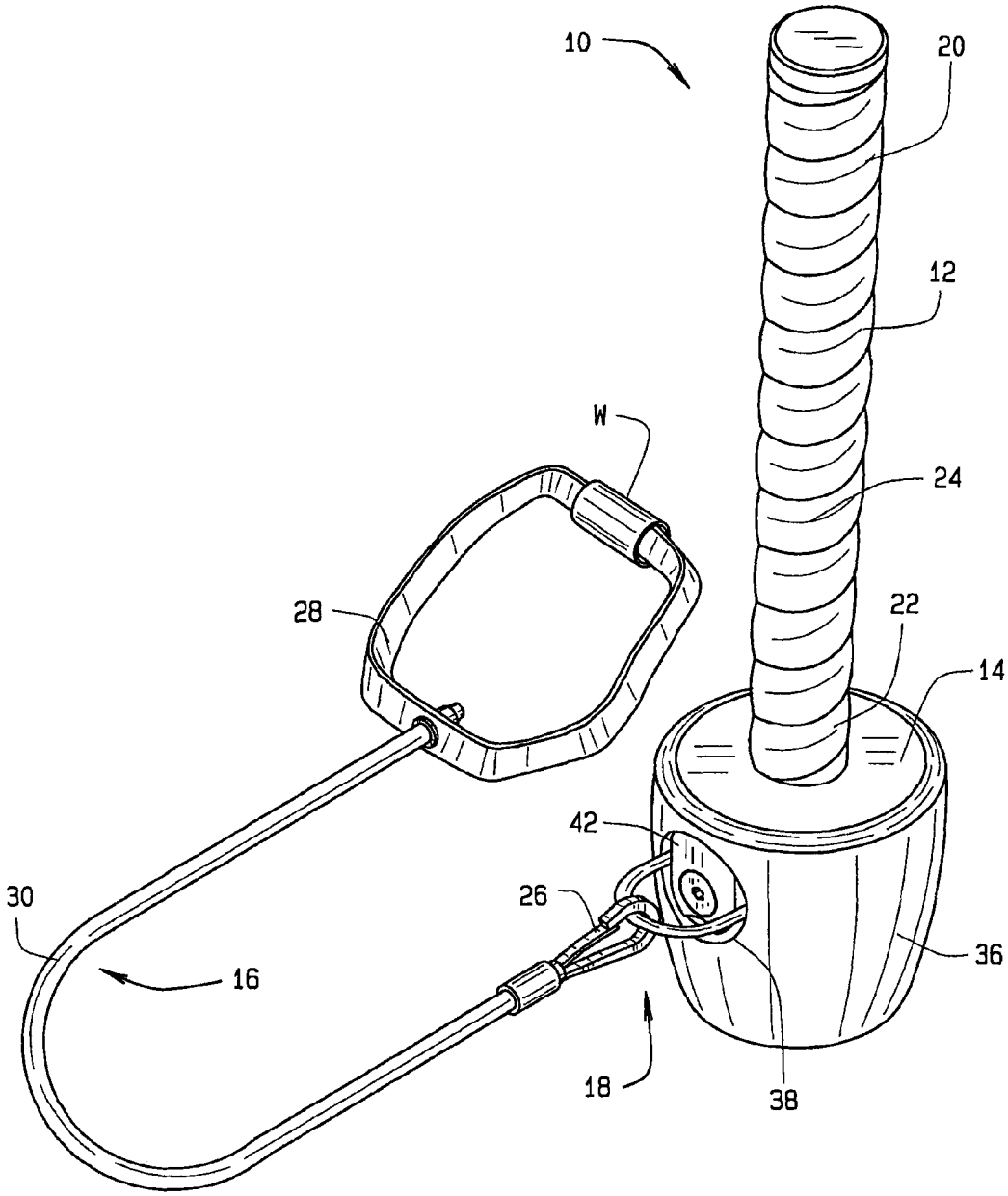
FIG. 1 is a perspective view of a conditioning device illustrating a handle, a weight, an bias assembly and a fastener assembly constructed in accordance with and embodying the principles of the present disclosure.

Referring now to FIG. 1, a conditioning device 10 constructed according to the principles of the present disclosure is shown. The conditioning device 10 is particularly adapted for training and conditioning for sports which involve the use of a hand held implement having a grip portion, for example, a bat, a club, a racket or a stick. The conditioning device 10 may be adapted for training and conditioning for a sport such as but not limited to golf. The conditioning device 10 comprises a handle 12, a weight 14, a bias assembly 16 and a fastener assembly 18. When assembled, the conditioning device 10 weighs more than the hand held implement used in the sport. In an embodiment, the handle 12 may be shaped like the grip portion of the sport's hand held implement. The handle 12 has a first end 20 and a second end 22. The first end 20 corresponds with the normal proximal end (i.e., the end closest to the user) of the sport implement while the second end 22 corresponds to the normal distal end (i.e., the end farthest from the user).

The handle 12 may be preferably configured between about ten and about fifty percent larger then the grip portion of the conventional sports implement, and most preferably about twenty percent larger than the grip portion of the conventional sports implement. This sizing of the grip portion focuses the effect of the conditioning device 10 on the user's forearms, yet still permits the user to securably grasp the conditioning device 10. Thus, in a case where a conventional golf club would have a grip circumference of between about 2¾ and about 3 inches, the handle 12 preferably has a circumference of between about 3 inches and about 3½ inches. The handle 12, however, may have the circumference of a conventional golf club.

The weight 14 mounts on the second end 22 of the handle 12. The weight 14 may be comprised of a variety of materials such as but not limited to steel or any other dense material. The length of the handle 12 and the size and the shape of the weight 14 are such that a center mass 24 of the conditioning device 10 is positioned distally between about 8 inches and about 18 inches from the first end 20 of the conditioning device 10. In an embodiment, the center mass 24 is positioned distally between about 6 inches and 9 inches from the first end 20 of the device 10. The weight value of the weight 14 depends upon the preferences of the user. The weight 14 may have a weight value so that the conditioning device 10 includes weights such as 1½, 2½, 3½, 5, 7½, 10, 12½ or 15 pounds or preferably a set of different weights 14 are provided.

As shown in FIG. 1, the weight 14 preferably has a generally cylindrical shape, and the top and bottom edges of the cylinder are preferably rounded. Of course the weight 14 could have some other shape, for example a polygonal cross section, a rectangular prism shape or a round shape. In the preferred embodiment, the weight for the 3½ pound device has a diameter of about 2⅜ inches, and is about 2½ inches high; the weight for the 5 pound device has a diameter of about 3 inches, and is about 2¾ inches high; the weight for the 7½ pound device has a diameter of about 3½ inches, and is about 3 inches high; the weight for the 10 pound device has a diameter of about 3¾ inches, and is about 3¾ inches high; and the weight for the 12½ pound device has a diameter of about 4 inches and is about 4 inches high.

Figure 4A:
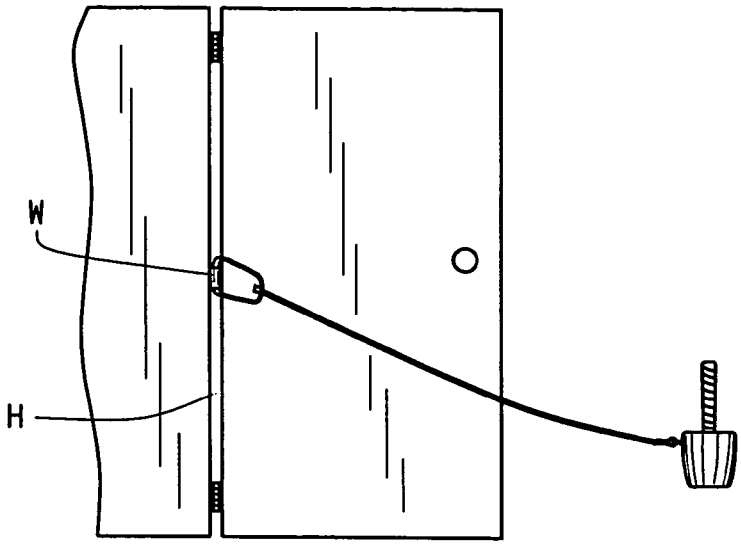
FIG. 4A is a perspective view of a wedge contacting a stationary object in the form a door hinge in accordance with and embodying the present disclosure.
Figure 4B:
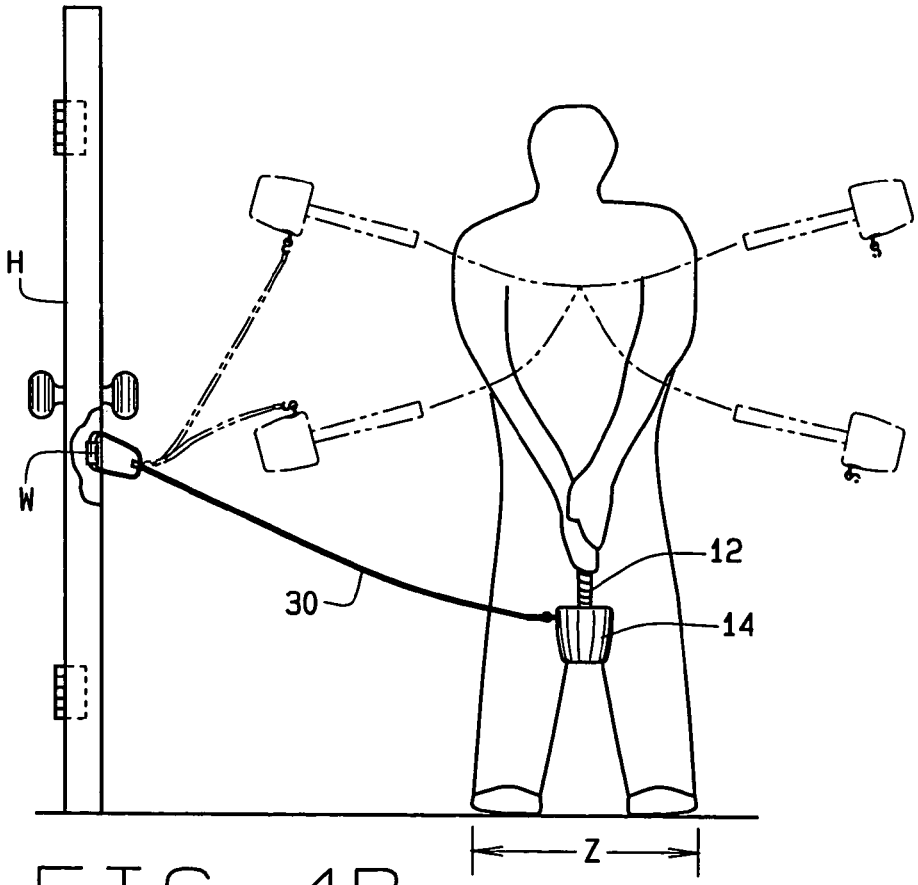
FIG. 4B is a perspective view of a user swinging the conditioning device in accordance with and embodying the present disclosure.

As shown in FIG. 1, the device 10 comprises the bias assembly 16 removeably attached to the weight 14. In an embodiment, the bias assembly 16 comprises a first bias end 26, a second bias end 28 and a bias member 30 disposed between the first bias end 26 and the second bias end 28. In an embodiment, the first bias end 26 may comprise a clasp while the second bias end 28 may comprise an attachment such as a loop with a wedge W (FIGS. 1 and 4A, 4B). The wedge W includes an aperture defined therethrough, wherein the loop inserts within the aperture of the wedge W. In an embodiment, the bias member 30 may comprise a cord of material such as a bungee cord, elastic resistive tubing or surgical material.

Figure 2:
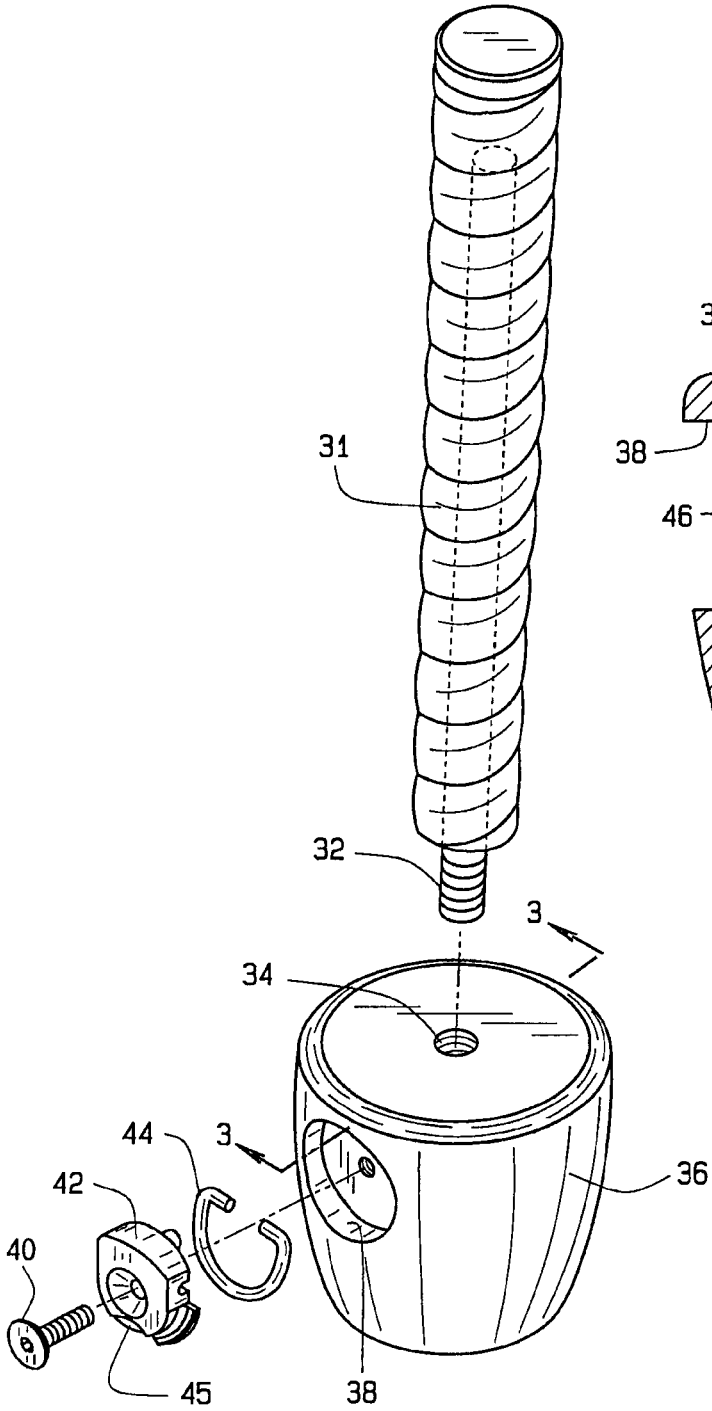
FIG. 2 is a view, partly broken away, illustrating details of the handle, the weight and the bias assembly constructed in accordance with and embodying the principles of the present disclosure.

Turning to FIG. 2, the conditioning device 10 is shown in a breakaway perspective view. The handle 12 includes a metal insert 31 having an externally threaded stud 32. The weight 14 includes an internally threaded socket 34 such that the externally threaded stud 32 engages the internally threaded socket 34. The threaded stud 32 may be further secured in the socket 34 with an adhesive, such as an epoxy or other suitable material. However, it may be desirable to have the weight 14 removably attached to the handle 12 so that the user can just have one handle 12 and change the weight of the device 10 by changing the weight 14. Other suitable methods of attaching the weight 14 to the handle 12 may be used. Additionally, the user may use the weight 14 with any sport specific handle.

As shown, the conditioning device 10 comprises an outer surface 36 that surrounds the weight 14. In an embodiment, the surface 36 may include an aperture 38 defined therein. As stated, the conditioning device 10 comprises the fastener assembly 18 that removably attaches to the weight 14. The fastener assembly 18 comprises a fastener 40, a removable retainer 42 and a hook 44 wherein the hook 44 connects to the retainer 42. The fastener 40, in turn, attaches the retainer 42 and hook 44 to the weight 14.

The retainer 42 includes side grooves such that the hook 44 may engage with the side grooves. The retainer 42 may also include a fastener groove positioned on a face of the retainer 42 such that the fastener 40 may embed within the fastener groove. Furthermore, the retainer 42 may include a finger latch 45 formed within the front face of the retainer 42. The finger latch 45 assists the user in manipulating and grabbing the hook 44. In an embodiment, the retainer 42 may be color-coded to indicate a particular weight value of the weight 14.

Figure 3:
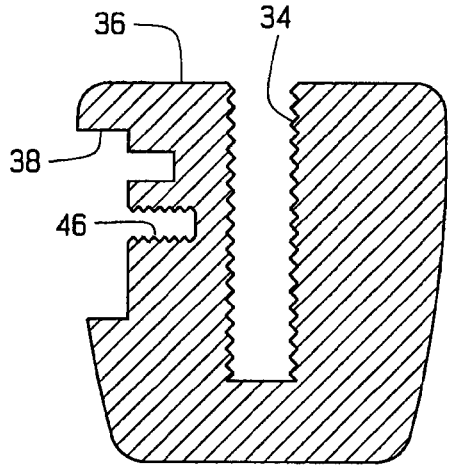
FIG. 3 is a cross sectional view of the weight of FIG. 2.

Referring to FIG. 3, the internally threaded socket 34 of the weight 14 traverses over half the height of the weight 14 to adequately secure the handle 12 to the weight 14. The weight 14 also includes another internally threaded socket 46 to engage with the fastener 40.

As shown in FIG. 1, the retainer 42 of the fastener assembly 18 positions within the aperture 38 of the outer surface 36, wherein the fastener assembly 18 removably attaches the bias assembly 16 to the weight 14. In an embodiment, the first bias end 26 removably connects with the hook 44 of the fastener assembly 18.

Referring to FIGS. 4A and 4B, a method of exercising for sports that uses a hand held implement having a grip portion such as golf is shown. In the method of use, the user grasps the conditioning device 10 having the handle 12 shaped like the grip portion of a golf club. The user then may removably attach the weight 14 to the handle 12 by mating the threaded stud 32 of the insert 31 with the internally threaded socket 34 of the weight 14. Next, the user may fasten the removable retainer 42, wherein the removable retainer 42 has a unique color code relating to the weight value of the weight 14. The user may then removably attach the bias assembly 16 to the weight 14 by connecting the first bias end 26 to the hook 44 of the fastener assembly 18. In attaching the bias assembly 16 to the weight 14, the user may insert a finger within the finger latch 45 to lift the hook 44 in order to expose the hook 44 to the first bias end 26. Alternatively, the user may attach the bias assembly 16 to the weight 14 prior to attaching the weight 14 to the handle 12.

The second bias end 28 is configured to removably attach to a secondary object 48. As such, the user attaches the second bias end 28 to provide resistance forces during at least some of the motions performed by the user. As illustrated in FIGS. 4A and 4B, the secondary object 48 may comprise a door hinge H wherein the wedge W of the second bias end 28 slips within the door hinge H and contacts the door hinge H to provide the resisting force of the conditioning device 10. As such, the user conveniently pushes the wedge W through the door hinge H and closes the associated door. Since the second bias end 28 and wedge W are attached, the wedge W prevents the second bias end 28 from slipping out of the door hinge H.

In another embodiment, the secondary object 48 may comprise a doorknob (FIG. 5) wherein the second bias end 28 easily slips over the doorknob to provide the resisting force of the conditioning device 10. The secondary object 48 may include other objects such as but not limited to a wall fixture or a human trainer.

Figure 5:
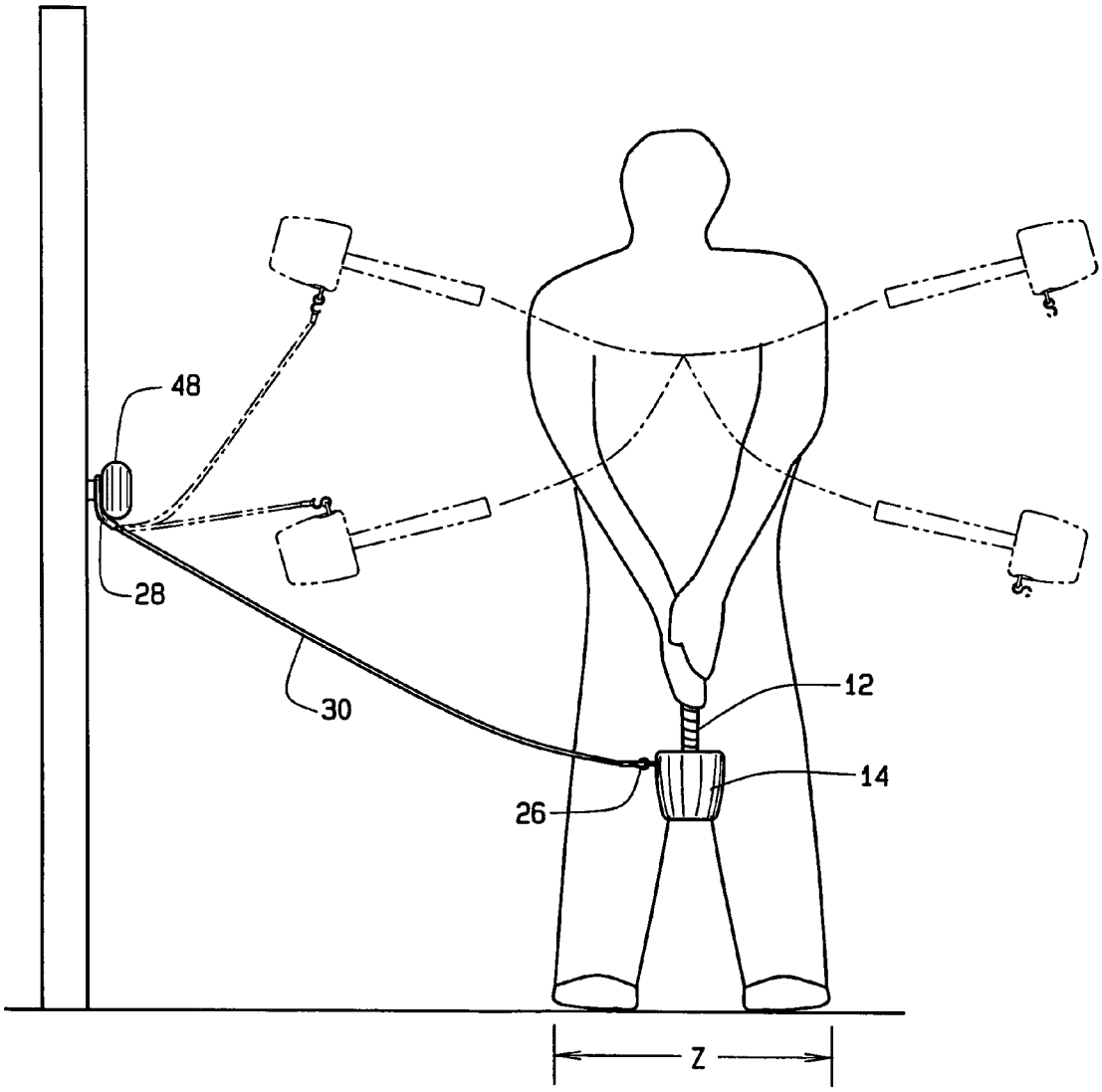
FIG. 5 is a perspective view of a user swinging the conditioning device in accordance with and embodying the present disclosure

After attaching the bias assembly 16 to the secondary object 48, the user swings the conditioning device 10 in a motion used during the specific sport such that the bias assembly 16 resists motion of the conditioning device 10 when attached to the secondary object 48 (FIGS. 4B and 5). Furthermore, the weight 14 provides additional forces applied to the user's forearms to further condition and train the user. Specifically, the weight 14 provides resistant forces for swing power through impact zone Z. Accordingly, for a golf motion, the weight 14 and bias assembly 16 resists movement of the conditioning device 10 through the down swing of the user, through the impact zone Z and through the up swing of the user. As such, the weight 14 and bias assembly 16 resists movement through at least some of the motions of the weighted handle 12. As illustrated, the weight 14 and bias assembly 16 resists positive and negative movement of the weighted handle 12.

Since the conditioning device 10 is particular adapted for training and conditioning for sports that involve the use of an implement having a grip, e.g., a bat, a club, a racket, or a stick, an embodiment of the present disclosure may be adapted for training and conditioning for baseball, softball, and other sports which employ a bat. In this embodiment (not shown), the device comprises a handle configured like the grip position of the sports implement, thus the device has a grip configured like the handle portion of a bat, having a first end and a second end. The first end corresponds to the normal proximal end (i.e., the end closest to the user) of the sports implement, while second end corresponds to normal distal end (i.e., the end furthest from the user). The handle is preferably made of wood, like a conventional bat, but it could also be made of some other material such as steel rod, molded rubber, metal and composites.

In an embodiment, the circumference of the handle is preferably between about ten and about fifty percent larger than the grip portion of the conventional sports implement, and most preferably about twenty percent larger than the grip portion of the conventional sports implement. This dimensioning helps focus the effect of the device on the user's forearms, yet still permits the user to securely grasp the device while reducing stress on the user's wrists. Thus, in the case where a conventional bat would have a grip diameter of between about ⅞ inches and about 1⅛ inches, the handle of this embodiment preferably has a diameter of between about 1¼ inches and about 1½ inches, and most preferably about 1 11/32 inches. The larger grip both isolates the forearms and safely strengthens the hands and wrists. However, the handle could have the circumference of a conventional bat.

Another embodiment (not shown) of the device is particularly adapted for training and conditioning for racket sports such as tennis, squash, racquetball etc. and the device comprises a grip configured like the handle portion of a racket, having a first end and a second end. The first end corresponds to the normal proximal end (i.e., the end closest to the user) of the sports implement, while the second end corresponds to normal distal end (i.e. the end furthest from the user). The handle is preferably made of wood, metal, or a composite material, like a conventional racket, but it could also be made of some other material.

In this embodiment, the circumference of the handle is preferably between about ten and about fifty percent larger than the grip portion of a conventional sports implement, and most preferably about twenty percent larger than the grip portion of a conventional sports implement. This dimensioning helps focus the effect of the device on the user's forearms, yet still permits the user to securely grasp the device. Thus, in the case where a conventional racket would have a grip circumference of between about 4¼ inches and about 4⅝ inches, the handle preferably has a circumference of between about 4⅜ inches and about 4⅞ inches. However, the handle could have the circumference of a conventional racket. The handle may include a conventional spiral wrap of leather or leather-like material, so that the handle has the appearance and feel of the grip portion of a conventional racket.

Another embodiment (not shown) is particularly adapted for training and conditioning for stick sports such as hockey and lacrosse, and comprises a grip configured like the handle portion of a stick, having a first end and a second end. The first end corresponds to the normal proximal end (i.e., the end closest to the user) of the sports implement, while second end corresponds to normal distal end (i.e., the end furthest from the user). The handle is preferably made of wood, like a conventional stick, but it could also be made of some other material.

In this embodiment, the circumference of the handle is preferably between about ten and about fifty percent larger than the grip portion of a conventional sports implement, and most preferably about twenty percent larger than the grip portion of a conventional sports implement. This dimensioning helps focus the effect of the device on the user's forearms, yet still permits the user to securely grasp the device. Thus, in the case where a conventional stick would have a grip circumference of between about 3¾ inches and about 4¼ inches, the handle preferably has a circumference of between about 4 inches and about 4½ inches. However, the handle could have the circumference of a conventional stick.

In operation, the user grasps the handle any of the embodiments of the present disclosure. (Of course a device can be constructed according to the principles of this disclosure for any sport in which the participant grasps and swings a sports implement). The user then swings the device, much as the user would swing implement that the device emulates. By controlling the size and shape and placement of the weight on the end of the handle, the training and conditioning effects are focused on the user's forearms. In particular, it is believe that by positioning the center of mass of the weight within 6-9 inches of the first end of the handle, the effect of the device is focused on the user's forearms. More specifically, it is important that the center of mass of the device is past the graspable portion of the handle, yet within 13 inches of the first end of the handle.

In view of the above, it will be seen that the several objects of the disclosure are achieved and other advantageous results are obtained. As various changes could be made in the above constructions without departing from the scope of the disclosure, it is intended that all matter contained in the above description or shown in the accompanying drawings shall be interpreted as illustrative and not in a limiting sense.

The invention claimed is:

1. A swing specific strength and conditioning device for a sport using a hand held implement having a grip portion, comprising:

a handle shaped like the grip portion of the hand held implement, the handle having a first end and a second end;

a weight removably attached to the second end in a fixed position with respect to the second end such that a center of mass for the conditioning device is less than about 13 inches from the first end of the handle, the weight having an outer surface defining an aperture through a side of the outer surface;

a fastener assembly removably attached to the weight at a single embedded location within the aperture of the weight, the fastener assembly having a retainer that is internally positioned in the embedded position within the aperture of the outer surface of the weight, the retainer having a hook pivotally attached thereto, the hook being configured to pivot between a first position within the aperture of the outer surface and a second position positioned out of the aperture of the outer surface, the retainer further having a finger latch positioned at a bottom of the retainer and positioned embedded within the aperture of the outer surface to provide a uniform silhouette for the weight outer surface in the first position of the hook; and a bias assembly removably attached to the hook of the retainer such that the bias assembly resists movement of the weight during at least some motion of the handle.

2. The conditioning device of claim 1 wherein the retainer has a color coded face to indicate a weight value of the weight.

3. The conditioning device of claim 1 wherein the conditioning device weighs more than the hand held implement used in the sport.

4. The conditioning device of claim 1 wherein the handle includes an externally threaded stud and the weight includes an internally threaded socket such that the externally threaded stud engages the internally threaded socket.

5. The conditioning device of claim 1 wherein the handle is shaped like a golf club grip.

6. The conditioning device of claim 1 wherein the center of mass of the conditioning device is between six and nine inches from the first end of the handle.

7. The conditioning device of claim 1 wherein the bias assembly comprises a first bias end, a second bias end and a bias member disposed between the first bias end and the second bias end.

8. The conditioning device of claim 7 wherein the bias member comprises an elastic resistive material.

9. The conditioning device of claim 7 wherein the second bias end is configured to removably attach to a secondary object.

10. A strength and conditioning device for a sport using a hand held implement having a grip portion such that the conditioning device is used in combination with a secondary object, comprising:

a handle shaped like the grip portion of the hand held implement, the handle having first end and second end;

a weight removably attached to the second end in a fixed position with respect to the second end such that a center of mass for the device is less than about 13 inches from the first end of the handle, the weight having an outer surface defining an aperture through a side of the weight;

a fastener assembly removably attached to the weight at a single location within the aperture of the weight, the fastener assembly having a retainer that is internally positioned in the embedded position within the aperture of the outer surface of the weight, the retainer having side grooves and having a hook pivotally attached to the side grooves, the hook being configured to pivot between a first position within the aperture of the outer surface and a second position positioned out of the aperture of the outer surface, the retainer further having a finger latch positioned at a bottom of the retainer and positioned embedded within the aperture of the outer surface to provide a uniform silhouette for the weight side wall in the first position of the hook; and a bias assembly removably attached to the hook of the retainer, wherein the bias assembly comprises a first bias end, a second bias end and a bias member disposed between the first bias end and the second bias end, the second end having a wedge attached thereto wherein the wedge removably attaches to the secondary object to resist positive and negative movement of the weighted handle.

11. The conditioning device of claim 10 wherein the retainer has a color coded face to indicate a weight value of the weight.

12. The conditioning device of claim 10 wherein the handle is shaped like a handle of a golf club grip.

13. The conditioning device of claim 10 wherein the conditioning device weighs more than the hand implement used in the sport.

14. The conditioning device of claim 10 wherein the bias member comprises an elastic resistive material.

* * * * *